US008701720B2

(12) United States Patent
Adriansens

(10) Patent No.: US 8,701,720 B2
(45) Date of Patent: Apr. 22, 2014

(54) UNIT FOR FILLING CONTAINERS, COMPRISING AN INSULATOR, ESPECIALLY FOR A PRODUCTION INSTALLATION

(75) Inventor: Eric Adriansens, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 671 days.

(21) Appl. No.: 12/742,479

(22) PCT Filed: Nov. 4, 2008

(86) PCT No.: PCT/EP2008/064932

§ 371 (c)(1),
(2), (4) Date: May 12, 2010

(87) PCT Pub. No.: WO2009/062863

PCT Pub. Date: May 22, 2009

(65) Prior Publication Data

US 2010/0252142 A1 Oct. 7, 2010

(30) Foreign Application Priority Data

Nov. 13, 2007 (FR) ..... 07 58981

(51) Int. Cl.

| | |
|---|---|
| ***B65B 1/04*** | (2006.01) |
| ***B65B 55/04*** | (2006.01) |
| ***B08B 9/08*** | (2006.01) |
| ***B65B 55/10*** | (2006.01) |

(52) U.S. Cl.

CPC ..... *B08B 9/0804* (2013.01); *B65B 55/10* (2013.01)

USPC ..... 141/92; 141/85; 141/93; 53/425; 53/426

(58) Field of Classification Search

USPC ..... 141/85, 92, 93; 53/425, 426

See application file for complete search history.

(56) References Cited

U.S. PATENT DOCUMENTS 4,597,242 A * 7/1986 Hendriks et al. ..... 53/426
4,992,247 A * 2/1991 Foti ..... 422/304

(Continued)

FOREIGN PATENT DOCUMENTS

DE 2 252 534 5/1974
EP 0 405 402 6/1990

(Continued)

OTHER PUBLICATIONS

International Search Report dated Jul. 21, 2009, from corresponding PCT application.

*Primary Examiner* — Timothy L Maust
(74) *Attorney, Agent, or Firm* — Young & Thompson

(57) ABSTRACT

A unit (10) for filling containers (14), includes an insulator (16) having a body (18) provided with an inlet (E) and an outlet (S), the structure (20) of the body (18) defining a space (V) forming an aseptic working region (22) and including insufflation elements (28) which are arranged in the upper part of the insulator (16) and are able to insufflate a sterile air flow for creating an overpressure inside the space (V). The insufflation elements (28) are arranged in the insulator (16) in such a way as to project a laminar-type flow (F) to lick the outer surface (44) of the containers (14), and the insulator (16) includes evacuation elements (48) which are separate from the inlet (E) and the outlet (S) and used to enable a controlled evacuation of the insufflated sterile air flow (F).

14 Claims, 1 Drawing Sheet

(56) References Cited

U.S. PATENT DOCUMENTS

| | | | | |
|---|---|---|---|---|
| 5,114,670 | A * | 5/1992 | Duffey | 422/24 |
| 5,947,170 | A * | 9/1999 | Poynter et al. | 141/93 |
| 6,120,730 | A * | 9/2000 | Palaniappan et al. | 422/28 |
| 6,360,788 | B1 * | 3/2002 | Saurin et al. | 141/93 |
| 6,691,747 | B1 * | 2/2004 | Marcus et al. | 141/7 |
| 6,755,224 | B2 | 6/2004 | Tawa et al. | |
| 7,523,596 | B2 * | 4/2009 | Dovesi | 53/425 |
| 7,669,390 | B2 * | 3/2010 | Py | 53/478 |
| 8,263,015 | B2 | 9/2012 | Raynaud | |

FOREIGN PATENT DOCUMENTS

| | | | |
|---|---|---|---|
| EP | 1 012 047 | | 1/2004 |
| EP | 1 647 488 | | 4/2006 |
| EP | 0903297 | B1 | 6/2009 |
| JP | H0329703 | A | 2/1991 |
| JP | H07285596 | A | 10/1995 |
| JP | H1191720 | A | 4/1999 |
| JP | 2004010138 | A | 1/2004 |
| WO | 2006090045 | A1 | 8/2006 |

* cited by examiner

UNIT FOR FILLING CONTAINERS, COMPRISING AN INSULATOR, ESPECIALLY FOR A PRODUCTION INSTALLATION

BACKGROUND OF THE INVENTION

1. Field of the Invention

The present invention relates to a container filling unit comprising an insulator, especially for a production installation.

2. Description of the Related Art

Numerous container production installations are known, in particular for bottles, such as the installation described in the document EP-B1-1,012,047.

Such a manufacturing installation generally comprises various units between which are arranged transfer means so as to be able to carry out the operations of the manufacturing process in succession from the formation of the container through to obtaining a filled and plugged container forming a finished product.

In an installation manufacturing bottles made of plastic material such as PET (polyethylene terephthalate), the first step, upstream, is to transform bottle preforms in a blowing unit, the forming being done by the blowing or the stretching/blowing in a mold of a preform previously heated in an oven.

Generally, the blowing unit is incorporated in the manufacturing installation so as to obtain a compact, single-piece installation, able to carry out all of the manufacturing process from the start through to obtaining finished products ready for marketing. As a variant, the unit is still arranged upstream so that the bottles produced can then directly feed the input of an installation combining all the units that follow it according to the manufacturing process.

The installation represented in FIG. 1 of this document mainly comprises, in addition to the abovementioned blowing unit, a cleaning unit in which a disinfecting or sterilizing treatment is carried out in order to decontaminate the interior and/or the exterior of the bottle, a filling unit and a plugging unit.

The manufacturing installation represented in FIG. 1 of the document EP-B1-1,012,047 comprises a sterile body delimiting a volume inside which are arranged the various units so that the manufacturing process is performed in an aseptic or sterile environment suitable for limiting the risks of contamination of the bottles produced.

In the manufacturing process, the container filling operation is usually recognized as the most sensitive operation with regard to the risks of contamination, in particular of airborne particle contaminations by germs, bacteria, etc., likely to contaminate notably the internal volume of the container.

This is why, in addition to the sterilizing or disinfecting treatments directly targeting the liquid and the container, in particular its internal wall, other means are generally implemented to reduce the risks of contamination, most particularly during filling.

In addition to the presence of a general body intended to isolate, from the surrounding atmosphere, an internal space inside which are arranged the manufacturing units of the installation, it is known to equip the filling unit with an insulator.

By definition, an insulator is a body that makes it possible to carry out operations with no risk of contamination.

FIG. 1 shows an example of such an insulator of a filling unit according to the state of the art known to the applicant, but which does not, however, give full satisfaction.

In practice, it has been observed for such a filling unit equipped with an insulator, that there notably remains a risk of contamination by particles that might be present on the external surface of the container and that might be likely to be detached by the turbulent air flow that is insufflated into the body of the insulator to create an overpressure therein.

SUMMARY OF THE INVENTION

The aim of the invention is therefore to resolve the abovementioned drawbacks and notably propose a solution that makes it possible to reduce the risks of particle contamination in such a filling unit comprising an insulator.

To this end, the invention proposes a unit for filling containers, especially for a container production installation, which comprises an insulator comprising an outer body provided with an inlet and an outlet, the body delimiting, with an internal structure, a volume forming an aseptic working area and comprising means of insufflating sterile air which, arranged at the top part of the insulator, are able to insufflate a flow of sterile air for creating an overpressure inside the volume, characterized in that the sterile air insufflation means are arranged in the top part of the insulator so as to project a laminar flow of sterile air to sweep over the outer surface of the containers and in that the insulator comprises, in the bottom part, exhaust means, separate from the inlet and from the outlet, intended to allow a controlled evacuation of the laminar flow of insufflated sterile air.

By combining the arrangement of the insufflation means and of the exhaust means according to the invention, if a particle present on the outer surface of the container becomes detached, it is then immediately picked up by the laminar flow of sterile air sweeping over the container and directly evacuated via the exhaust means out of the body of the insulator.

Advantageously, the exhaust means are produced in a simple and economical manner by omitting to fill the bottom dynamic seal of the insulator of the filling unit with sterilizing liquid, thus creating a passage through which the laminar flow of sterile air flows naturally.

The invention can therefore easily be implemented on an existing filling unit with insulator.

According to other characteristics of the invention:

- the sterile air insufflation means are arranged with a predetermined inclination corresponding to an angle which is defined by the intersection of a main axis of the insufflation means with a reference vertical axis of the insulator;
- the reference vertical axis of the insulator is parallel to the main axis of the containers which extend vertically in order to be filled;
- the exhaust means are located as close as possible to the containers in order for the laminar flow of insufflated sterile air to be primarily evacuated from the body by said exhaust means;
- the bore of the exhaust means is greater than the bore of the inlet and/or the outlet of the insulator that are provided in the body;
- the insulator comprises extraction means associated with the exhaust means so as to control the evacuation of the laminar flow of sterile air;
- the insulator of the filling unit comprises dynamic sealing means, respectively at least one top dynamic seal and one bottom dynamic seal, which are arranged between the body and a moving part of the internal structure, each of said dynamic seals comprising a first sealing element and a second sealing element between which elements sealing is ensured by the presence of a sterilizing liquid in which at least a part of the first and second elements is immersed and the exhaust means consist of the bottom dynamic seal between the first and second elements of which no sterilizing liquid is introduced so as to create a passage intended to directly evacuate, after the containers have been swept over, the laminar flow of insufflated sterile air;

the laminar flow of sterile air is able to drive toward the exhaust means any contaminating particles present on the outer surface of the container, which in particular are likely to contaminate the internal volume of the containers;

the value of the overpressure created in the aseptic working area of the insulator is less than or equal to 15 pascal (Pa) so as to maintain a laminar-type flow for the flow of insufflated sterile air.

The invention also proposes a container manufacturing installation comprising a filling unit, characterized in that the installation comprises a containment body with controlled atmosphere delimiting an internal volume in which are arranged at least one cleaning unit, the filling unit and a plugging unit and associated sterile air insufflation means able to create an overpressure in said internal volume of the containment body, the value of which overpressure is less than the value of the overpressure created in the aseptic working area of the insulator.

BRIEF DESCRIPTION OF THE DRAWING FIGURES

Other features and benefits of the invention will become apparent on reading the following detailed description, for an understanding of which reference should be made to the appended drawings in which.

DETAILED DESCRIPTION OF THE INVENTION

Figure 1:
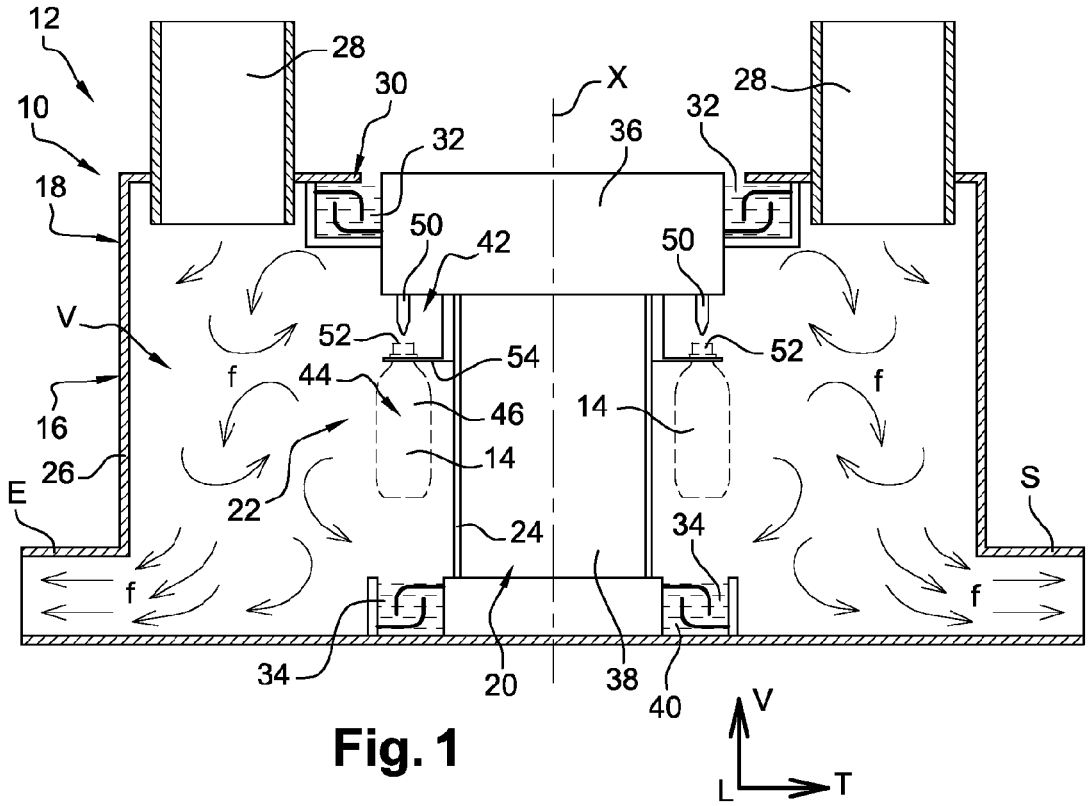
FIG. 1 is a diagrammatic view of a filling unit according to the state of the art comprising an insulator equipped with sterile air insufflation means, which illustrates in particular the turbulent flow of the sterile air flow in the aseptic working area in which at least the filling of the containers is carried out.

In the following description and the claims, the terms such as "top" and "bottom", "axial" and "radial" and the longitudinal, vertical and transversal orientations will be used in a nonlimiting manner to respectively designate elements according to the definitions given in the description and relative to the trihedron (L, V, T) represented in the figures.

In the description, identical, similar or analogous elements will be designated by the same reference numerals.

In order to explain the invention, FIG. 1 shows a filling unit 10 according to the state of the art, which is notably able to be incorporated in a container production installation 12.

Hereinafter in this description, the term "container" designates, in a generic and nonlimiting manner, all types of containers 14, such as bottles, flasks, etc.

The container filling unit 10 comprises an insulator 16 in order to carry out the container filling operations in a controlled environment with, in particular, high disinfection or sterilization conditions suitable for ensuring a reduced risk of contamination of the containers 14 by pathogenic particles or agents, such as bacteria, germs, etc.

As is known, such an insulator 16 comprises an outer body 18 which is respectively provided with an inlet opening "E" through which the containers 14 to be filled, coming from upstream, are introduced into the insulator 16 and an outlet opening "S" through which the containers 14 are evacuated downstream out of the body 18 of the insulator 16.

The insulator 16 here comprises an internal structure 20 which is centrally arranged and which is topped and surrounded by the body 18.

The body 18 delimits, with the internal structure 20, a volume "V" forming an aseptic working area 22 which, for example, has an annular form and is radially contained between the internal face of a wall 24 delimiting the internal structure 20 and the internal face of a wall 26 of the body 18.

The insulator 16 also comprises sterile air insufflation means 28 which are usually arranged in the top part of the insulator 16 in order to insufflate a flow "f" of sterile air inside the volume "V" forming the aseptic working area 22 in which the containers 14 introduced through the inlet opening E are intended to be filled in succession.

The flow f of sterile air insufflated by the insufflation means 28 is for creating an overpressure inside the volume V to insulate the aseptic working area 22 from the risks of external contaminations from particles (germs, viruses, bacteria, etc.) that are likely to be notably present in the surrounding air situated outside the body 18 and around the insulator 16.

In practice, the filling of the container 14 is usually considered to be the operation during which the risk of contamination of the container, in particular of its internal volume, is most critical.

By virtue of the overpressure created inside the body 18 of the insulator 16, such particles cannot penetrate into the aseptic working area 22 from the outside in an airborne manner.

Thus, the degree of sterilization or disinfection is at least partly controlled. In practice, the control is not, however, total given that particles are likely to be introduced into the insulator 16 by the containers 14.

This is also the reason why the insulator 16 comprises dynamic sealing means 30 respectively consisting here of a top dynamic seal 32 and a bottom dynamic seal 34.

In practice, the insulator 16 comprises a top part 36 of the internal structure 20 which is mounted to move rotation-wise relative to the body 18 and relative to a fixed bottom part 38 of the internal structure 20 forming a rack.

The dynamic sealing means 30 are arranged between the body 18 and said moving top part 36 of the internal structure 20 of the insulator 16.

The moving part 36 usually comprises a carousel provided with a plurality of filling stations which are distributed circumferentially and which can each be moved with a container from the inlet opening E to the outlet opening S while, during this travel, at least filling the container 14.

The top dynamic seal 32 and the bottom dynamic seal 34 forming the dynamic sealing means 30 are, for example, arranged at the top and bottom ends of the wall 24, at the junction between the internal structure 20 and the body 18.

The top dynamic seal 32 and the bottom dynamic seal 34 each respectively comprise a first sealing element 32*a*, 34*a* and a second sealing element 32*b*, 34*b* between which sealing is ensured by the presence of a sterilizing liquid 40 in which at least a part of said first and second elements is immersed.

Consequently, the containers 14 introduced through the inlet E are the main possible propagation vector for particles.

The containers 14 therefore usually undergo an aseptic treatment upstream of the insulator 16, after which treatment the containers 14 are taken up by conventional transfer means (not represented) and introduced continuously through the inlet opening E into the body 18 of the insulator 16, in the aseptic working area 22 in order to be filled therein.

The flow f of sterile air insufflated by the insufflation means 28 flows vertically from top to bottom in a turbulent-type flow through the aseptic working area 22 in which the containers 14 are notably filled.

In practice, the flow f of sterile air flows from the insufflation means 28 by partly "falling" directly above the containers 14 and the filling means 42 borne by the carousel 36 that forms the moving part of the internal structure 20.

The rotation of the assembly 14, 36, 42 therefore provokes strong eddies in the flow f of air which is therefore necessarily a turbulent-type flow.

Furthermore, the flow f of sterile air maintaining the overpressure inside the insulator 16 is evacuated through the inlet E and outlet S openings of the body 18, inlet E and outlet S openings through which the containers 14 are continually introduced or evacuated in such a way as to further help in provoking a flow f of sterile air that is turbulent.

Thus, it will be understood that, if one of the containers 14 comprises, for example on its outer surface 44, a contaminating particle such as a bacterium, a germ, etc., there is then a risk of airborne contamination of the aseptic working area 22 by this particle and more particularly of contamination of the internal volume 46 of one of the containers 14 introduced into said aseptic working area 22 in order to be filled.

The aim of the invention is consequently to propose a simple and economic solution that makes it possible to control the risk of particle contamination by such particles that would be likely to be present on the outer surface 44 of the container 14 despite the disinfecting or sterilizing treatment operations on the container 14 performed upstream of the insulator 16.

According to the invention, the sterile air insufflation means 28 are arranged in the top part of the insulator 16 so as to project a laminar flow F of sterile air to sweep over the outer wall 44 of the containers 14 and the insulator 16 comprises, in the bottom part, exhaust means 48 to allow for a controlled evacuation of the flow F of insufflated sterile air.

Figure 2:
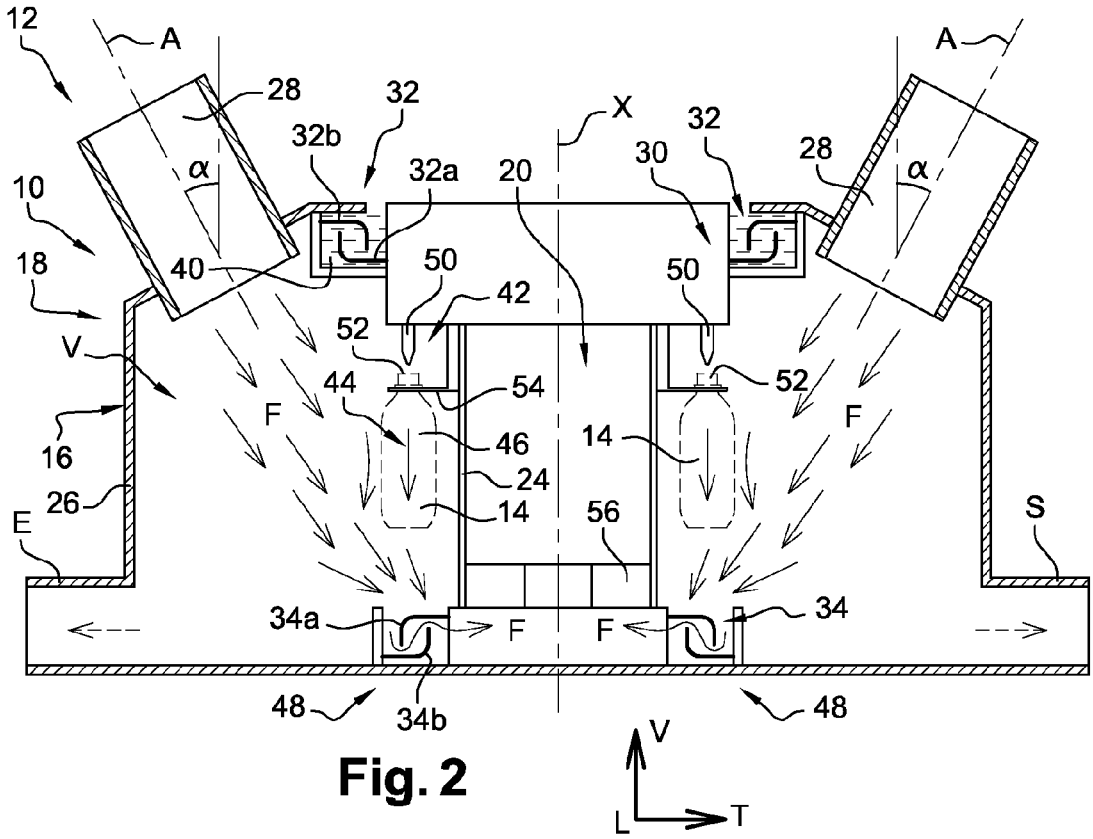
FIG. 2 is a diagrammatic view of a filling unit according to the invention which illustrates the laminar flow of the sterile air flow in the aseptic working area which sweeps over the outer surface of the container before being evacuated by the associated exhaust means.

FIG. 2 shows an example of a unit 10 for filling containers 14 according to the invention which will be described hereinbelow by comparison with the unit represented in FIG. 1.

Consequently, the means of the filling unit 10 according to the invention that are similar or identical will not be described again in detail and will be designated by the same reference numerals as those used for the unit according to the state of the art represented in FIG. 1.

Advantageously, the insufflation means 28 are arranged in the top part of the insulator 16, in this case of its body 18, with a predetermined inclination of angle "α".

The angle α of inclination is defined by the intersection of a main axis A of the insufflation means 28 with reference vertical axis X of the insulator 16.

The value of the angle α is determined in such a way that the laminar flow F of sterile air flows vertically overall from top to bottom while sweeping over the outer wall 44 of each container 14 introduced into the aseptic working area 22 in order to be filled.

The reference vertical axis X of the insulator 16 is in this case parallel to the main axis of the containers 14 which extend vertically below filling means 42 able to introduce a predetermined quantity of liquid into each container.

Conventionally, the filling is done by means of a filling spout 50 that can be introduced into an opening 52 of the container 14 held in position by support means 54 in order to pour the liquid therein.

As can be seen in FIG. 2, the laminar flow F of sterile air flows well in a laminar-type, and therefore non-turbulent, flow before being evacuated by the exhaust means 48.

Advantageously, the exhaust means 48 are located as close as possible to the containers 14 and as far away as possible from the inlet E and outlet S openings of the insulator 16.

Furthermore, the bore of the exhaust means 48 is advantageously greater than the bore of the inlet E and/or the outlet S of the insulator 16 provided in the wall 26 of the body 18.

Advantageously, the laminar flow F of sterile air insufflated by the insufflation means 28 is mainly evacuated out of the body 18 by said exhaust means 48 and no longer by the inlet E or outlet S openings so that the flow of the laminar flow F through the aseptic working area 22 is totally controlled to further reduce the risk of particle contamination of the internal volume 46 of one of the containers 14 or of a part of the unit 10 such as the filling means 42.

In practice, in a unit 10 comprising insufflation 28 and exhaust 48 means arranged according to the teachings of the invention, if a particle present on the outer surface 44 of the container 14 becomes detached, this particle is then immediately picked up by the laminar flow F of sterile air sweeping over the container 14 and driven downward by the laminar flow F so as to be directly evacuated out of the aseptic working area 22 via the exhaust means 48 of the insulator 16.

Advantageously, the laminar flow F of sterile air can drive, toward the exhaust means 48, the air contained inside each container 14 which air, during filling operations, is progressively expelled through the top opening 52 for filling the container 14.

Advantageously, the insulator 16 comprises extraction means 56 associated with the exhaust means 48 so as to provoke an additional suction effect and ensure that the laminar flow F of sterile air is evacuated mainly, that is to say almost totally, by the exhaust means 48.

Preferably, the air of the laminar flow F sucked in by the extraction means 56 is evacuated outside into the atmosphere so that the contaminating particles present in this air cannot contaminate, in an installation 12, the other units adjacent to the filling unit 10.

In a variant, the air of the laminar flow F sucked in by the extraction means 56 could be recycled to feed, in return, the insufflation means 28, the recycling comprising treatment operations, notably filtration and/or sterilization, of the extracted air before it is reintroduced in order to be able to ensure that it is free of all contaminating particles.

According to a preferred embodiment of the invention, the exhaust means 48 comprise the bottom dynamic seal 34 between the first and second elements 34*a*, 34*b* of which no sterilizing liquid 40 is introduced so as to deliberately create a passage able to directly evacuate, after the containers 14 have been swept over, the laminar flow F of sterile air insufflated by the insufflation means 28.

Advantageously, the bottom dynamic seal 34 can therefore receive or not receive sterilizing liquid 40 in order to form, in a particularly simple and economical manner, the exhaust means 48 associated with the insufflation means 28 inclined according to the invention.

The sterilizing liquid 40 is thus introduced selectively into the bottom dynamic seal 34 according to whether the requirement is respectively to open, during container 14 filling operations, a passage for the controlled evacuation of the laminar flow F through said bottom dynamic seal 34, or to close said passage, for example, to re-establish sealing during insulator 16 servicing operations, in particular decontamination of the aseptic working area 22.

In a variant, the exhaust means 48 are produced in a given part of the insulator 16, for example in the wall 24 of the internal structure 20, the dynamic sealing means 30, 32 and 34 then being kept operational.

The invention can consequently be easily implemented in a filling unit 10 simply by modifying the insufflation means 28 for the laminar flow F, without other substantial modifications, in particular for producing the exhaust means 48 for the laminar flow F when the latter consist of the opening of the bottom seal 34.

Preferably, the value of the overpressure created in the aseptic working area 22 of the insulator 16 is less than or equal to 15 pascal (Pa) in order for the flow of the sterile air flow to be always of laminar type.

Advantageously, the filling unit 10 with insulator 16 that has just been described can be incorporated in an installation 12 for manufacturing containers 14 that is not represented in detail.

Such an installation 12 is, for example, of single-piece type, like the installation represented in FIG. 1 of the above-mentioned document EP-B1-1,012,047.

Advantageously, such an installation 12 for manufacturing containers 14 comprises a containment body (not represented) with controlled atmosphere delimiting an internal volume inside which the various units needed to implement the manufacturing process are arranged.

For this, the installation 12 comprises at least one cleaning unit, one filling unit according to the invention and one plugging unit to seal the filled containers 14.

The installation 12 also comprises associated sterile air insufflation means that can create an overpressure in said internal volume of the containment body.

Advantageously, the value of the overpressure created in the internal volume of the containment body is less than the value of the overpressure created in the aseptic working area 22 of the insulator 16 of the filling unit 10.

The value of the overpressure created in the aseptic working area 22 of the insulator 16 of the filling unit 10 is, for example, between 10 and 15 pascal, whereas the value of the overpressure created in the containment body is of the order of 7 pascal.

Advantageously, a positive pressure gradient is created relative to the atmospheric pressure outside the installation, the value of the overpressure increasing according to the scale of the particle contamination risks.

By virtue of such a pressure gradient, the circulation of air in the installation 12 is always from the cleanest and most sensitive areas, in this case the aseptic working area 22 of the insulator 16 of the filling unit 10, toward the less sensitive areas, namely, in succession, the internal volume of the containment body comprising the other units then the atmosphere outside the body of the installation.

Preferably, such an installation 12 for manufacturing containers comprises, upstream of the cleaning unit, a blowing unit able to produce the containers 14, for example bottles made of PET, obtained by blowing or stretching/blowing from preforms previously heated in an oven before being introduced into a mold.

The invention claimed is:

1. A unit (10) for filling containers (14), which comprises:

an insulator (16) comprising an outer housing (18) provided with an inlet (E) and an outlet (S) through which the containers (14) are respectively introduced and evacuated downstream out of the housing (18), the housing (18) delimiting with an internal structure (20) a volume (V) forming an aseptic working area (22) comprising means (28) for insufflating sterile air which, arranged at the top part of the insulator (16), are able to insufflate a sterile air flow for creating an overpressure inside the volume (V), in which the insulator (16) comprises, in the bottom part, exhaust means (48), separate from the inlet (E) and from the outlet (S), intended to allow a controlled evacuation of the flow of insufflated sterile air, the means (28) for insufflating sterile air are adapted to insufflate a laminar flow (F) of insufflated sterile air and are arranged in a top part of the insulator (16) with a predetermined inclination so as to project the laminar flow (F) of sterile air toward an outer peripheral surface (44) of the containers (14) with an angle ($\alpha$) which is defined by the intersection of a main axis (A) of the means for insufflation (28) with the main axis of the containers (14) which extend vertically in order to be filled.

2. The filling unit (10) as claimed in claim 1, wherein the means for exhaust (48) are located adjacent to the containers (14) in order for the laminar flow (F) of insufflated sterile air to be primarily evacuated from the outer housing (18) by said means for exhaust (48).

3. The filling unit (10) as claimed in claim 1, wherein a bore of the means for exhaust (48) is greater than a bore of the inlet (E) and/or the outlet (S) of the insulator (16) that are provided in the outer housing (18).

4. The filling unit (10) as claimed in claim 1, wherein the insulator (16) comprises means for extraction (56) associated with the means for exhaust (48) so as to control evacuation of the laminar flow (F) of sterile air.

5. A unit (10) for filling containers (14), which comprises:

an insulator (16) comprising an outer body (18) provided with an inlet (E) and an outlet (S);

a volume (V) delimited by an internal structure (20) of the outer body (18), the volume forming an aseptic working area (22);

means (28) for insufflating sterile air which, arranged at the top part of the insulator (16), are able to insufflate an air flow for creating an overpressure inside the volume (V), the means (28) for insufflating sterile air are arranged in a top part of the insulator (16) so as to project a laminar flow (F) of sterile air to sweep over an outer surface (44) of a plurality of containers (14); and, means for exhaust (48) in a bottom part of the insulator (16), the means for exhaust being separate from the inlet (E) and from the outlet (S), so as to allow a controlled evacuation of the laminar flow (F) of insufflated sterile air, wherein the insulator (16) comprises means for dynamic sealing (30), respectively at least one top dynamic seal (32) and one bottom dynamic seal (34), which are arranged between the outer body (18) and a moving part (36) of the internal structure (20), each of said dynamic seals (32, 34) comprising a first sealing element (32*a*, 34*a*) and a second sealing element (32*b*, 34*b*) between which sealing is ensured by presence of a sterilizing liquid (40) in which at least a part of first and second elements (32*a*, 34*a*, 32*b*, 34*b*) is immersed, wherein the means for exhaust (48) comprises the bottom dynamic seal (34) between the first and second elements (34*a*, 34*b*) of which no sterilizing liquid (40) is introduced, thus creating a bore intended to directly evacuate, after the containers (14) have been swept over, the laminar flow (F) of insufflated sterile air.

6. The filling unit (10) as claimed in claim 1, wherein the laminar flow (F) of sterile air is able to drive toward the means for exhaust (48) any contaminating particles present on the outer surfaces (44) of the plurality of containers (14), which are likely to contaminate an internal volume (46) of the containers (14).

7. The filling unit (10) as claimed in claim 1, wherein a value of the overpressure created in the aseptic working area (22) of the insulator (16) is less than or equal to 15 pascal (Pa) so as to maintain laminar flow for the flow (F) of insufflated sterile air.

8. A container manufacturing installation (12), comprising:

the filling unit (10) as claimed in claim 1, wherein the installation (12) comprises a containment body with controlled atmosphere delimiting an internal volume in which are arranged at least one cleaning unit, the filling unit (10) and a plugging unit and associated means for sterile air insufflation being able to create an overpressure in said internal volume of the containment body, the value of which overpressure is less than the value of the overpressure created in the aseptic working area (22) of the insulator (16).

9. A unit for filling containers which comprises:

an insulator comprising an outer housing provided with an inlet and an outlet through which the containers are respectively introduced and evacuated downstream out of the housing, the housing delimiting with an internal structure (20) a volume forming an aseptic working area comprising a sterile air insufflator which, arranged at the top part of the insulator, insufflates a sterile air flow for creating an overpressure inside the volume, in which the insulator comprises, in a bottom part, an exhaust, separate from the inlet and from the outlet intended to allow a controlled evacuation of the flow of insufflated sterile air, the insufflator being adapted to insufflate a laminar flow (F) of insufflated sterile air and are arranged in a top part of the insulator with a predetermined inclination toward an outer peripheral surface of the containers with an angle ($\alpha$) which is defined by the intersection of a main axis of the insufflator with the main axis of the containers (14) which extend vertically in order to be filled.

10. The filling unit as claimed in claim 9, wherein the exhaust is located adjacent to the containers in order for the laminar flow of insufflated sterile air to be primarily evacuated from the outer housing by said exhaust.

11. The filling unit as claimed in claim 9, wherein a bore of the exhaust is greater than a bore of the inlet and/or the outlet of the insulator that are provided in the outer housing.

12. The filling unit as claimed in claim 9, wherein the insulator comprises an extractor associated with the exhaust so as to control evacuation of the laminar flow of sterile air.

13. The filling unit as claimed in claim 9, in which the insulator comprises a dynamic seal arrangement, respectively at least one top dynamic seal and one bottom dynamic seal, which are arranged between the outer body and a moving part of the internal structure, each of said dynamic seals comprising a first sealing element and a second sealing element between which sealing is ensured by presence of a sterilizing liquid in which at least a part of first and second elements is immersed, wherein the exhaust comprises the bottom dynamic seal between the first and second elements of which no sterilizing liquid is introduced, thus creating a bore intended to directly evacuate, after the containers have been swept over, the laminar flow of insufflated sterile air.

14. The filling unit as claimed in claim 9, wherein the laminar flow of sterile air is able to drive toward the exhaust any contaminating particles present on the outer surfaces of the plurality of containers, which are likely to contaminate an internal volume of the containers.

* * * * *

UNITED STATES PATENT AND TRADEMARK OFFICE

CERTIFICATE OF CORRECTION

PATENT NO. : 8,701,720 B2
APPLICATION NO. : 12/742479
DATED : April 22, 2014
INVENTOR(S) : Eric Adriansens It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 776 days.

Signed and Sealed this
Twenty-ninth Day of September, 2015

Michelle K. Lee

Michelle K. Lee
*Director of the United States Patent and Trademark Office*